US007025872B2

(12) United States Patent
Picard et al.

(10) Patent No.: US 7,025,872 B2
(45) Date of Patent: Apr. 11, 2006

(54) PROCESS FOR OBTAINING A FEEDSTOCK THAT CAN BE USED IN AN ETHERIFICATION UNIT

(75) Inventors: Florent Picard, Saint Symphorien d'Ozon (FR); Alain Forestiere, Vernaison (FR); Julia Magne-Drisch, Vilette de Vienne (FR); Nathalie Marchal-George, Saint Genis Laval (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 87 days.

(21) Appl. No.: 10/761,240

(22) Filed: Jan. 22, 2004

(65) Prior Publication Data

US 2004/0167363 A1 Aug. 26, 2004

(30) Foreign Application Priority Data

Jan. 22, 2003 (FR) ..... 03 00693

(51) Int. Cl.
*C10G 47/14* (2006.01)

(52) U.S. Cl. ..... 208/100; 208/95; 208/143; 208/145; 585/6; 585/259; 585/260; 585/275; 585/276; 585/277; 585/500; 585/800; 585/809; 585/841

(58) Field of Classification Search ..... 585/6, 585/259, 260, 275, 276, 277, 500, 800, 809, 585/841; 208/143, 145, 95, 100

See application file for complete search history.

(56) References Cited

U.S. PATENT DOCUMENTS

| | | | | |
|---|---|---|---|---|
| 4,175,033 | A * | 11/1979 | Hilfman | 208/143 |
| 5,321,163 | A | 6/1994 | Hickey et al. | |
| 5,712,415 | A * | 1/1998 | Ramirez De Agudelo et al. | 564/490 |
| 5,948,942 | A | 9/1999 | Ramirez de Agudelo et al. | |
| 5,968,347 | A * | 10/1999 | Kolodziej et al. | 208/213 |
| 6,042,719 | A * | 3/2000 | Shih | 208/217 |
| 6,123,830 | A * | 9/2000 | Gupta et al. | 208/76 |
| 6,210,561 | B1 * | 4/2001 | Bradow et al. | 208/89 |
| 6,830,678 | B1 * | 12/2004 | Didillon et al. | 208/211 |
| 2004/0178123 | A1 * | 9/2004 | Podrebarac | 208/211 |

* cited by examiner

*Primary Examiner*—Rosalynd Keys
(74) *Attorney, Agent, or Firm*—Millen, White, Zelano & Branigan, P.C.

(57) ABSTRACT

Process for obtaining a hydrocarbon fraction that can be used as a feedstock of an etherification unit and that contains a small amount of diene compounds, nitrogen-containing compounds and sulfur-containing compounds, starting from an initial hydrocarbon feedstock that comprises a mixture of olefins, dienes, and nitrites as well as sulfur-containing compounds, whereby said process comprises at least the following successive stages:

a) a selective hydrogenation of said initial hydrocarbon feedstock in the presence of a catalyst of group VIII of the periodic table, b) a fractionation by distillation of the effluents that are obtained from stage a) under conditions that make it possible to obtain at least two fractions including
said hydrocarbon fraction and that comprises a small amount of diene compounds, nitrogen-containing compounds and sulfur-containing compounds, and
a heavy fraction that contains heavy hydrocarbons and the majority of the nitrogen-containing compounds and sulfur-containing compounds obtained from the hydrogenation of stage a).

20 Claims, No Drawings

PROCESS FOR OBTAINING A FEEDSTOCK THAT CAN BE USED IN AN ETHERIFICATION UNIT

This invention relates to a process for obtaining a hydrocarbon fraction that can be used as a feedstock of an etherification unit and that contains a small amount of diene compounds, nitrogen-containing compounds and sulfur-containing compounds, starting from an initial hydrocarbon feedstock.

More particularly, this invention finds its application in the treatment of gasolines for the purpose of obtaining a fraction that comprises olefins that contain 4 to 6 carbon atoms and that exhibit a low content of diene compounds, nitrile compounds, nitrogen-containing compounds and sulfur-containing compounds, whereby this fraction can then be used to supply etherification units, for example for the purpose of producing methyl-tert-butyl ethers (MTBE), ethyl tert-butyl ethers (ETBE), tert-amyl methyl ether (TAME) or tert-amyl ethyl ether (TAEE).

It is known that the activity of the acid catalysts that are generally used in the etherification units can be greatly reduced because of the presence of undesirable compounds in the fraction to be treated. Among these compounds, the diolefins (dienes) can be the source of polymer deposition on the catalyst, and the nitrites produce a gradual deactivation of the catalyst. In contrast, certain compounds such as the light sulfides and the amines exhibit a certain basicity and can also gradually degrade the activity of acid catalysts.

The drawbacks that are linked to these pollutants are described in, for example, Patent Application WO 96/00714.

Numerous studies that are aimed at eliminating such compounds from the fraction that is used as a feedstock in the etherification units have been proposed. The majority recommend a washing by solvent, most often by water to eliminate the nitrites at least partially. However, the relatively low solubility of certain nitrites such as the propionitrile in the polar solvents requires large amounts of solvent that should then be withdrawn, whereby these processes thereby generate a non-negligible additional expense.

Various processes have been proposed to facilitate the elimination of pollutants. By way of example, it is possible to cite:

- U.S. Pat. No. 5,569,790 that discloses a process that is aimed at eliminating traces of acetone, acetonitriles or propionitriles in a hydrocarbon fraction that comprises 4 to 6 carbon atoms. The nitrites are finally eliminated by washing with water. The waste water is regenerated before being recycled to the process.
- U.S. Pat. No. 5,675,043 that proposes a process for eliminating the nitrile-type nitrogen-containing compounds from a hydrocarbon fraction by extraction with a glycol-type solvent.

These two processes, however, exhibit the drawback of generating a polar solution that contains the nitrogen-containing compounds that are extracted from the hydrocarbon fraction. This polar solution should be withdrawn and regenerated to be recycled into the process, which makes the unit more complex.

- U.S. Pat. No. 5,300,126 that discloses a process for eliminating diolefins, the C4/C5 fractions are brought into contact with a dienophile such as maleic anhydride. The basic nitrogen-containing compounds and the diolefins are extracted after they have reacted with the maleic anhydride.

Patent Application WO 96/00714 proposes a process that is intended to reduce the content of pollutants that are present in the feedstocks for etherification units by selective hydrogenation. The pollutants that are eliminated by this process are nitrites and diolefins. In a first step, the diolefins are hydrogenated into olefins, then the nitriles are hydrogenated into amines. The catalyst that is used in this stage is a catalyst that comprises cobalt. The amines being basic compounds, the former are then easily extracted by washing with water. This process therefore itself also requires the implementation of a washing stage so as to eliminate the nitrogen-containing compounds in amine form and therefore exhibits the above-mentioned drawback of withdrawal of the washing solutions.

This invention proposes an economical and simple means to be used to eliminate, at least partially, the dienes, the nitrile-type nitrogen-containing compounds and the light sulfur-containing compounds that are present in the initial gasoline. The process that is used according to the invention comprises at least two stages: a first stage of selective hydrogenation of the entire initial hydrocarbon feedstock and a second stage of fractionation of said hydrogenated feedstock.

During said hydrogenation, the applicant found that under the indicated conditions, not only the dienes are transformed into olefins without the latter being substantially hydrogenated, but surprisingly and unexpectedly, a substantial amount, and even all of the nitrile-type nitrogen-containing compounds are transformed into heavier nitrogen-containing compounds, just as a portion and even all of the light sulfur-containing compounds are transformed into heavier sulfur-containing compounds.

According to the invention, it thus is possible during a subsequent fractionation stage to concentrate by simple distillation the nitrogen-containing compounds and sulfur-containing compounds into the heaviest fractions that are obtained from said fractionation.

More specifically, this invention relates to a process for obtaining a hydrocarbon fraction that can be used as a feedstock of an etherification unit and that contains a small amount of diene compounds, nitrogen-containing compounds and sulfur-containing compounds, starting from an initial hydrocarbon feedstock that comprises a mixture of olefins, dienes, and nitriles, as well as sulfur-containing compounds, whereby said process comprises at least the following successive stages:

a) a selective hydrogenation of said initial hydrocarbon feedstock, in the presence of a catalyst of group VIII of the periodic table, b) a fractionation by distillation of the effluents that are obtained from stage a), under conditions that make it possible to obtain at least two fractions, including
   - said hydrocarbon fraction and comprising a small amount of diene compounds, nitrogen-containing compounds and sulfur-containing compounds, and
   - a heavy fraction that contains heavy hydrocarbons and the majority of the nitrogen-containing compounds and sulfur-containing compounds obtained from the hydrogenation of stage a).

In general, said hydrocarbon fraction exhibits a higher fraction point or boiling point that is less than 100° C., preferably less than 80° C., and very preferably less than 60° C.

The invention will be better understood from reading the following preferred embodiment of the invention, given as a purely illustrative and in no way limiting example.

According to this embodiment, the following stages are carried out:

1°) Selective Hydrogenation (Stage a):

This stage is intended to eliminate at least partially the diolefins that are present in the initial hydrocarbon feedstock, such as preferably a gasoline fraction. The diolefins are gum precursors that polymerize in the etherification reactors and by limiting their service life as well as the nitrile-type nitrogen-containing compounds (whose formula is given below). The applicant actually found that under the experimental conditions mentioned in the description below, said nitrites are transformed into heavy nitrogen-containing compounds that respond positively to the measurement of basic nitrogen.

Nitrile-type compounds: R—C≡N, where R comprises 1 to 6 carbon atoms.

This stage also makes it possible to transform the light sulfur-containing compounds, such as the mercaptans, the sulfides and the CS2 whose boiling point is generally less than that of thiophene, into heavier sulfur-containing compounds whose boiling point is higher than that of thiophene.

Said selective hydrogenation stage generally takes place in the presence of a catalyst that comprises at least one metal of group VIII of the periodic table, preferably selected from the group that is formed by platinum, palladium and nickel, and a substrate. Without exceeding the scope of the invention, the cobalt can also be selected from said group. For example, a catalyst that contains 1 to 20% by weight of nickel that is deposited on an inert substrate, such as, for example, alumina, silica, silica-alumina, a nickel aluminate or a substrate that contains at least 50% alumina, will be used. Another metal of group VIB of the periodic table can be combined with this metal of group VIII to form a bimetallic catalyst, such as, for example, molybdenum or tungsten. This metal of group VIB is preferably deposited at the level of 1% by weight to 20% by weight on the substrate.

The selection of operating conditions is particularly important according to the invention. The operation most generally will be performed under pressure in the presence of an amount of hydrogen that slightly exceeds the stoichiometric value that is necessary for hydrogenating the diolefins. The hydrogen and the feedstock to be treated are injected in upward or downward flows in a reactor preferably with a fixed catalyst bed. The temperature is most generally between 50 and 300° C., and preferably between 80 and 250° C., and very preferably between 120 and 210° C.

The pressure is selected as adequate to maintain more than 80%, and preferably more than 95%, by weight of the gasoline to be treated in liquid form in the reactor; it is most generally between 0.4 to 5 MPa, inclusive, and preferably more than 1 MPa. An advantageous pressure is between 1 and 4 MPa, inclusive.

Under these conditions, the volumetric flow rate is on the order of 1 to 12 $h^{-1}$, preferably on the order of 2 to 10 $h^{-1}$.

The initial hydrocarbon feedstock, such as a gasoline fraction, can contain up to several % by weight of diolefins. After hydrogenation, the diolefin content is most often reduced to less than 5000 ppm, preferably less than 2500 ppm, and even less than 1500 ppm.

According to a possible embodiment of the invention, stage a) takes place in a catalytic hydrogenation reactor that comprises a catalytic reaction zone through which runs all of the feedstock and the amount of hydrogen that is necessary to carry out the desired reactions.

2°) Separation of the Nitrogen-Containing Compounds That are Obtained from Stage a) (Stage b))

The applicant found, surprisingly enough, that all of the nitrogen-containing compounds obtained from hydrogenation stage a) exhibited a boiling point that was higher than 55° C. and could consequently be separated by simple distillation from the fraction that comprises the olefins that contain 4 to 6 carbon atoms and that was intended to supply etherification units.

Thus, the nitrogen-containing compounds that are obtained from stage a) are compounds with a boiling point that is higher than those of hydrocarbons that comprise 5 carbon atoms. In addition, these compounds react to the measurement of basic nitrogen according to the ASTM 4739 method.

Stage b) consists of a separation of nitrogen-containing compounds by distillation. The effluents that are obtained from stage a) are fractionated so as to produce at least two fractions including a light fraction that comprises the majority of the hydrocarbons and primarily olefins that have 4 or 5 carbon atoms and are free of nitrogen-containing compounds, and a heavy fraction that concentrates the heavy hydrocarbons and the nitrogen-containing compounds whose weight is increased during stage a). In addition to the nitrogen-containing compounds, this preferred embodiment also makes it possible to eliminate at least partially the sulfur-containing compounds from said light fraction.

The content of nitrogen-containing compounds of the light fraction of the gasoline that is obtained from stage b) generally contains less than 20 ppm of nitrogen, preferably less than 10 ppm of nitrogen, and very preferably less than 5 ppm of nitrogen.

The content of light sulfur-containing compounds in the light fraction of the gasoline is generally less than 200 ppm, preferably less than 100 ppm, and very preferably less than 50 ppm of sulfur.

So as to better understand the advantages that are linked to this invention, the following examples are provided by way of non-limiting example.

EXAMPLE 1

For Comparison

A gasoline A that is obtained from a catalytic cracking unit is distilled in a preparative distillation column in three fractions: a light gasoline with an end point of 55° C., an intermediate gasoline with a starting point of 55° C. and an end point of 140° C., and a heavy gasoline with a starting point of 140° C. Each fraction that is thus produced is analyzed. The analyses that are carried out are presented in detail below:

Basic nitrogen: Measurement of the nitrogen in basic form according to the ASTM 4739 method Total nitrogen: Measurement of the total nitrogen according to the ASTM 4629 method MAV: Measurement of the diolefin content IBr: Bromine number, measurement of the olefin content S: Measurement of the elementary sulfur content Table 1 summarizes the characteristics of gasoline A as well as the 3 fractions that are obtained by distillation.

TABLE 1

| | Gasoline A | PI-55 | 55–140 | 140+ |
|---|---|---|---|---|
| Density | 0.716 | 0.6504 | 0.7382 | 0.842 |
| Basic Nitrogen (ppm) | 9 | 1 | 1 | 71 |
| Total Nitrogen (ppm) | 21 | 15 | 13 | 110 |

TABLE 1-continued

| | Gasoline A | PI-55 | 55–140 | 140+ |
|---|---|---|---|---|
| MAV (mg/g) | 14 | 6.5 | 15.5 | 30 |
| IBr | 101 | 130 | 79 | 48 |
| S (ppm) | 780 | 92 | 926 | 2563 |
| Yield (% by weight) | 100 | 29.59 | 64.27 | 6.14 |

The light gasoline that corresponds to the PI-55 fraction concentrates the major portion of light olefins (C4 and C5). It therefore constitutes the etherification feedstock. This fraction comprises 15 ppm of nitrogen, 92 ppm of sulfur, and an MAV (maleic acid value) of 6.5, which corresponds to close to 0.8% by weight of diolefins. This gasoline that is treated on an etherification acid catalyst would produce a premature deactivation of the latter.

EXAMPLE 2

According to the Invention

The example below is in accordance with this invention. The initial feedstock that is used is similar to that of Example 1.

After a first treatment of selective hydrogenation in a first stage a), the gasoline that is produced (gasoline B) is distilled into three fractions (stage b)).

Stage a) is carried out in the following way: gasoline A is treated on a fixed-bed reactor that is loaded with catalyst HR845® with a nickel and molybdenum base that is marketed by the Axens Company in the presence of hydrogen. The reaction is carried out at 165° C. under a pressure of 20 bar (2 MPa) and a volumetric flow rate of 4 $h^{-1}$. The $H_2$/feedstock ratio, expressed in liter of hydrogen per liter of feedstock, is 6. The gasoline that is thus produced during stage a) is gasoline B, whose characteristics are provided in Table 2.

Gasoline B is then fractionated by distillation into 3 fractions whose fraction points are identical to the fractions of Example 1.

The characteristics of gasoline B and the three final fractions are combined in Table 2.

TABLE 2

| | Gasoline B | PI-55 | 55–140 | 140+ |
|---|---|---|---|---|
| Sp Gr | 0.7166 | 0.6518 | 0.7375 | 0.8474 |
| Basic Nitrogen, ppm | 13 | <1 | 6 | 173 |
| Total Nitrogen, ppm | 21 | <1 | 12 | 230 |
| MAV (mg/g) | 0.8 | 0.2 | 7 | 8.1 |
| IBr | 98 | 128.7 | 93 | 47 |
| S, ppm | 782 | <1 | 928 | 2719 |
| Yield (% by weight) | 100 | 27.4 | 66.7 | 5.4 |

It is noted that the PI (starting point of the distillation)-55° C. fraction of gasoline B that concentrates the C4 and C5 olefins that are intended to supply the etherification unit becomes greatly depleted in diolefins and is lacking in nitrogen-containing compounds and sulfur-containing compounds. This fraction can therefore be used directly as an etherification unit feedstock, without it being necessary to use an additional stage for extracting nitrogen-containing compounds.

This example shows that it is possible, according to the invention, to produce a $C_4$–$C_5$ fraction that becomes depleted in diolefins and is lacking in nitrogen-containing compounds without resorting to a stage for eliminating nitrogen-containing compounds by washing but with a simple distillation. Likewise, thanks to this process, the sulfur-containing compounds have also been greatly reduced, and even totally eliminated, from the PI-55° C. fraction of the gasoline.

The invention claimed is:

1. A process for obtaining a hydrocarbon fraction that can be used as a feedstock of an etherification unit and that contains a small amount of diene compounds, nitrogen-containing compounds and sulfur-containing compounds, starting from an initial hydrocarbon feedstock that comprises a mixture of olefins, dienes, and nitriles as well as sulfur-containing compounds, whereby said process comprises at least the following successive stages:

a) a selective hydrogenation of said initial hydrocarbon feedstock in the presence of a catalyst that comprises at least one metal of group VIII and another metal of group VIB of the periodic table, under conditions sufficient to convert dienes to olefins and to convert nitrogen-containing compounds to nitrogen-containing compounds having a boiling point higher than 55° C., while not significantly hydrogenating said olefins, b) a fractionation by distillation of the effluents that are obtained from stage a) under conditions that make it possible to obtain at least two fractions including a light hydrocarbon fraction comprising olefins and a small amount of diene compounds, nitrogen-containing compounds and sulfur-containing compounds, and a heavy fraction that contains heavy hydrocarbons and the majority of the nitrogen-containing and sulfur-containing compounds obtained from the hydrogenation of stage a).

2. A process according to claim 1, in which the metal of group VIII is selected from the group that consists of platinum, palladium and nickel.

3. A process according to claim 2, in which the catalyst contains 1% by weight to 20% by weight of nickel that is deposited on an inert substrate.

4. A process according to claim 1, in which the metal of group VIII is cobalt.

5. A process according to claim 1, in which said catalyst comprises 1% by weight to 20% by weight of metal of group VIB.

6. A process according to claim 1, in which the metal of group VIB is molybdenum or tungsten.

7. A process according to claim 1, in which said catalyst operates under a pressure of 0.4 to 5 MPa, at a temperature of 50 to 300° C. with an hourly volumetric flow rate of the feedstock of 1 $h^{-1}$ to 12 $h^{-1}$.

8. A process according to claim 1, in which said hydrogenation is carried out in the presence of an amount of hydrogen that slightly exceeds the stoichiometric value that is necessary for hydrogenating all of the dienes that are present in the initial hydrocarbon feedstock.

9. A process according to claim 1, in which said hydrocarbon fraction has a final boiling point that is less than 100° C.

10. A process according to claim 9, in which said final boiling point is less than 60° C.

11. A process according to claim 1, wherein the olefins separated in step (b) into said light hydrocarbon fraction have primarily 4–5 carbon atoms.

12. A process according to claim 1, wherein the diolefin content is reduced from several percent to less than 5000 ppm.

13. A process according to claim 1, wherein the diolefin content is reduced from several percent to less than 2500 ppm.

14. A process according to claim 1, wherein the diolefin content is reduced from several percent to less than 1500 ppm.

15. A process according to claim 1, wherein said light hydrocarbon fraction contains less than 20 ppm of nitrogen.

16. A process according to claim 1, wherein said light hydrocarbon fraction contains less than 5 ppm of nitrogen.

17. A process according to claim 12, wherein said light hydrocarbon fraction contains less than 20 ppm of nitrogen.

18. A process according to claim 14, wherein said light hydrocarbon fraction contains less than 20 ppm of nitrogen.

19. A process according to claim 12, wherein said light hydrocarbon fraction contains less than 5 ppm of nitrogen.

20. A process according to claim 14, wherein said light hydrocarbon fraction contains less than 5 ppm of nitrogen.

* * * * *